US006460203B1

(12) United States Patent
De Simone

(10) Patent No.: US 6,460,203 B1
(45) Date of Patent: Oct. 8, 2002

(54) WATER-DRIVEN TRAVERSE-REVERSE MECHANISM FOR WATERWORKS, PARTICULARLY SHOWERS, WATER TONIC-MASSAGE FIXTURES AND THE LIKE

(76) Inventor: Fiorentino De Simone, Largo Olgiata, 15-Inola 2/E 00123, Rome (IT)

( * ) Notice: Subject to any disclaimer, the term of this patent is extended or adjusted under 35 U.S.C. 154(b) by 0 days.

(21) Appl. No.: 09/763,700

(22) PCT Filed: Aug. 20, 1999

(86) PCT No.: PCT/IT99/00270

§ 371 (c)(1),
(2), (4) Date: Feb. 26, 2001

(87) PCT Pub. No.: WO00/11274

PCT Pub. Date: Mar. 2, 2000

(30) Foreign Application Priority Data

Aug. 25, 1998 (IT) ..... RM98A0557

(51) Int. Cl.[7] ..... A47K 7/02; A47K 3/20
(52) U.S. Cl. ..... 4/606; 4/567
(58) Field of Search ..... 4/606, 567

(56) References Cited

U.S. PATENT DOCUMENTS 4,274,400 A 6/1981 Baus
4,339,833 A 7/1982 Mandell
4,704,756 A 11/1987 Williams et al.
5,035,010 A 7/1991 Sakamoto et al.

FOREIGN PATENT DOCUMENTS

DE 93 02 933 7/1993
DE 93 06 104 9/1993
DE 295 05063 8/1995
GB 2 231 487 11/1990

*Primary Examiner*—Charles E. Phillips
(74) *Attorney, Agent, or Firm*—Young & Thompson

(57) ABSTRACT

A drive apparatus comprising in combination a mechanism of the screw-nut screw type capable of reversing automatically the movement whenever the nut screw reaches a limit stop without stopping and/or reversing the direction of rotation of the screw.

More particularly the drive apparatus includes an axially fixed screw (3) rotating only in one direction, and a nut screw (4) moving axially and capable of engaging said screw to which rotating brushes, massaging rolls, a shower head and so on can be secured. Such mechanism has an essentially cylindrical shape and is driven by a water-driven motor (2) preferably provided with demultiplier.

In order that the user can vary the excursion of the shift of the nut screw, two adjustable limit stops (8) are provided which are capable of interacting with a control lever (9) for reversing the movement.

9 Claims, 11 Drawing Sheets

WATER-DRIVEN TRAVERSE-REVERSE MECHANISM FOR WATERWORKS, PARTICULARLY SHOWERS, WATER TONIC-MASSAGE FIXTURES AND THE LIKE

BACKGROUND OF THE INVENTION

The present invention relates to sanitary fixtures and more particularly a drive apparatus to be used in the shower box and/or for the water tonic-massage fixtures for moving automatically sponges or rotating rolls to have a tonic massage and/or to facilitate particularly the washing of body's parts which can be hardly reached such as back.

SUMMARY OF THE INVENTION

Some Patent Applications in the name of the same Applicant are known and disclose water tonic-massage fixtures and massotherapy apparatus provided with water-driven means wherein the rotatable devices are vertically moved by floatation hydrosystems or gears and racks. Even if such equipments guarantee their operation by water-driven means or by low-voltage electrical devices with the maximum safety for the user, they have a complex construction with large overall dimensions, moreover their installation is difficult.

U.S. Pat. No. 4,339,833, U.S. Pat. No. 4,274,400, DE-U-2950063, D-U-9302933, U.S. Pat. No. 5,035,010, and GB-A-2231487 disclose various water-driven shower or bath apparatuses provided with means for automatically reversing the movement, but these are mechanically very complicated, or they waste a lot of water, or they require a pressurized water supply, or they need modifications to the existing plumbing and/or building works or they are very complicated in the installation.

One object of the present invention is to provide a water-driven apparatus that is compact and easy to be installed, and guarantees a regular movement with automatic reversal without stoppage.

A second object of the present invention is to provide a drive apparatus for regulating independently upper and lower limit stops, thus allowing the excursion of the movement to be regulated.

According to the invention this is accomplished by providing a drive apparatus comprising in combination a water-driven motor, a demultiplier, and a mechanism of the screw-nut screw type capable of reversing automatically the movement whenever the nut screw reaches a limit stop without stopping and/or reversing the direction of rotation of the screw.

A better understanding of the invention will result from the following detailed description with reference to some preferred embodiments thereof.

Figure 1:
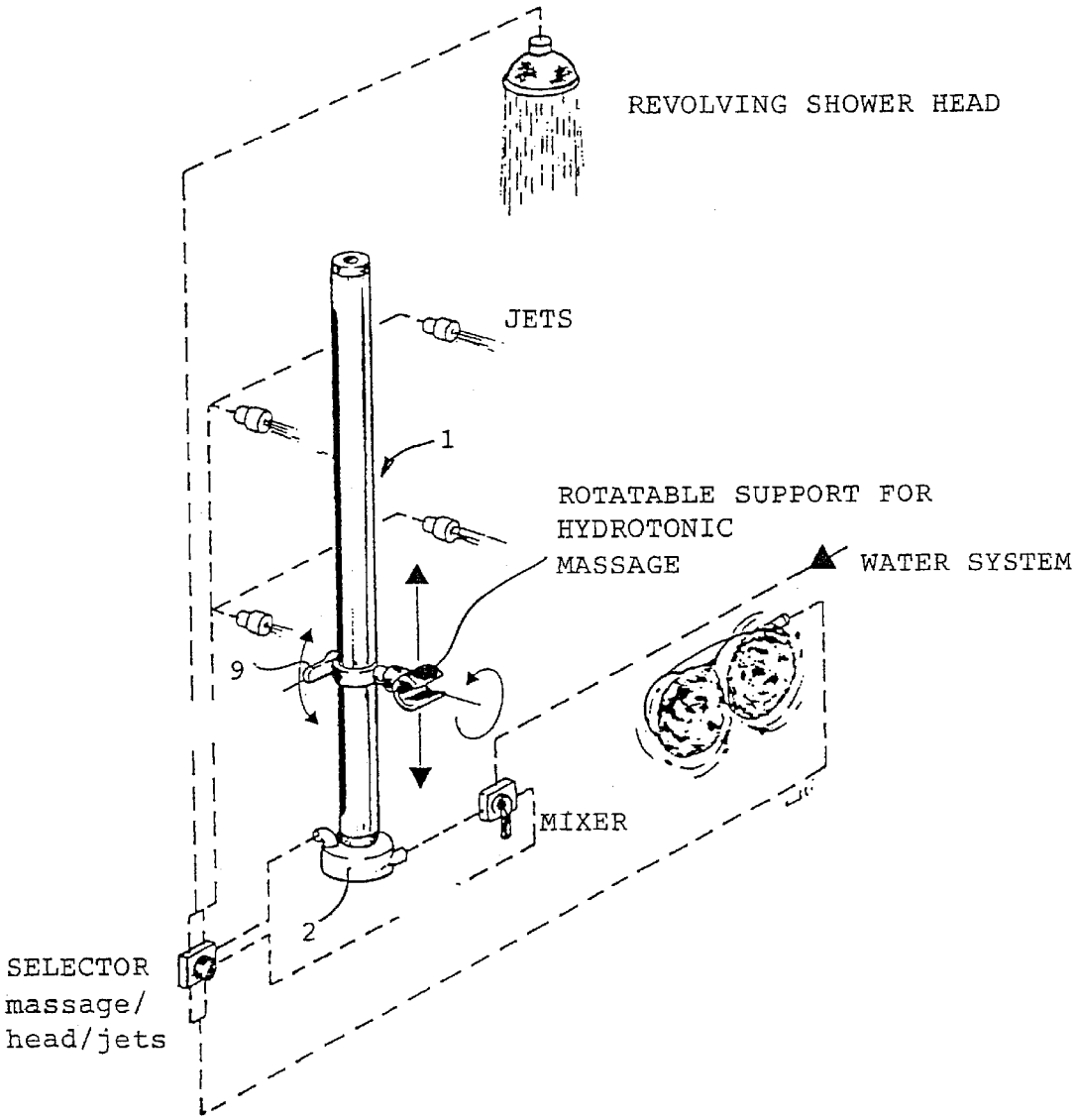
FIG. 1 is a schematic view showing how the apparatus according to the invention is installed.
Figure 2:
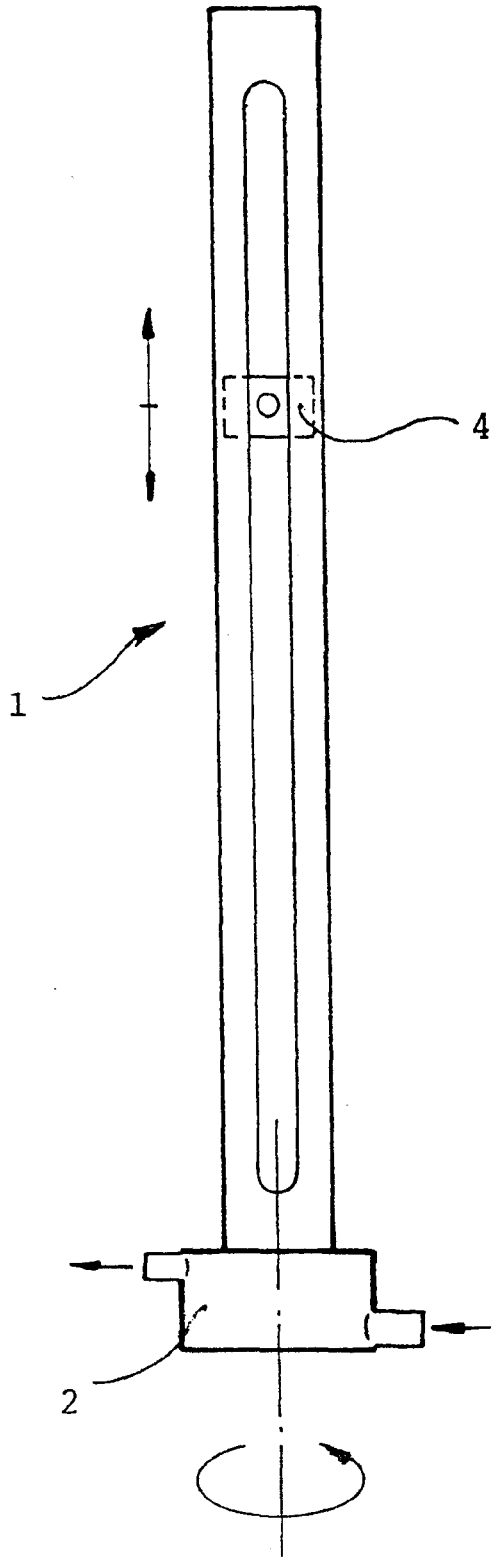
FIG. 2 is a schematic view of a first embodiment of the invention.
Figure 3:
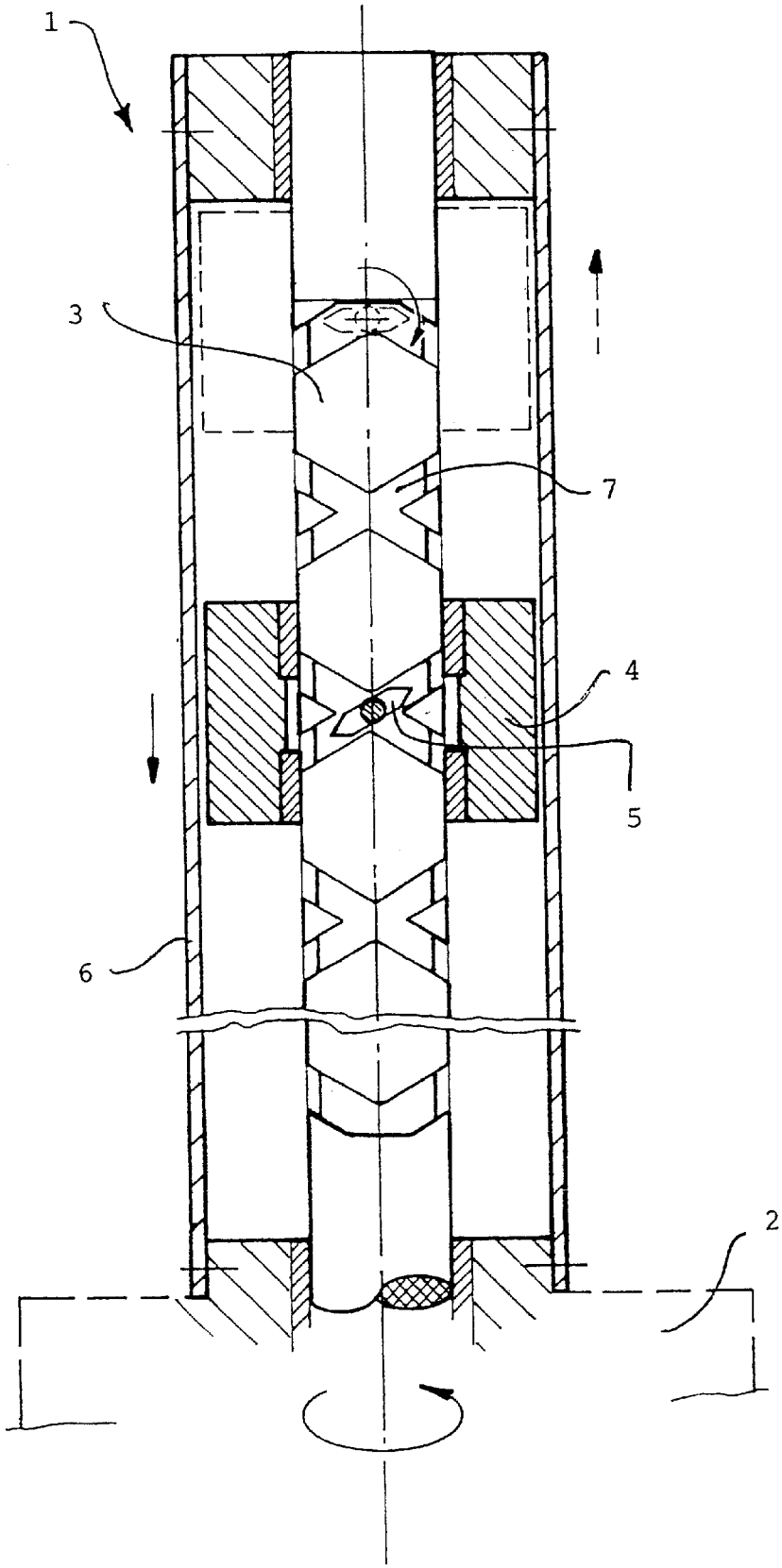
FIG. 3 is an axial section of a detail of the apparatus of FIG. 2 in its down stroke position.
Figure 5:
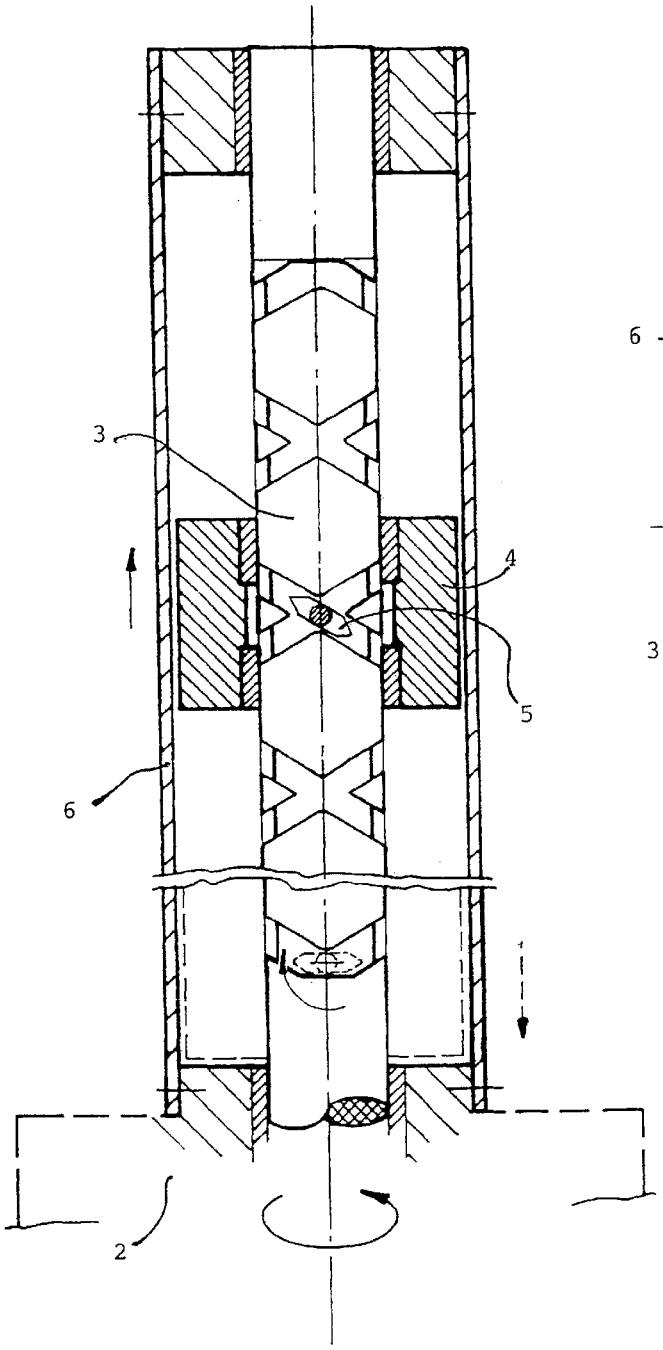
FIG. 5 shows like FIG. 3 the apparatus in its upstroke position.
Figure 4:
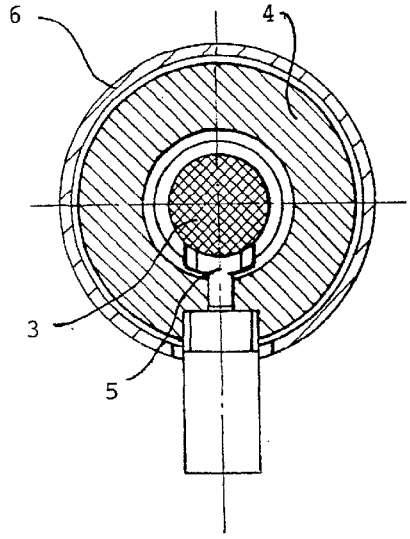
FIG. 4 is a cross section showing the mesh between screw and nut screw.
Figure 6:
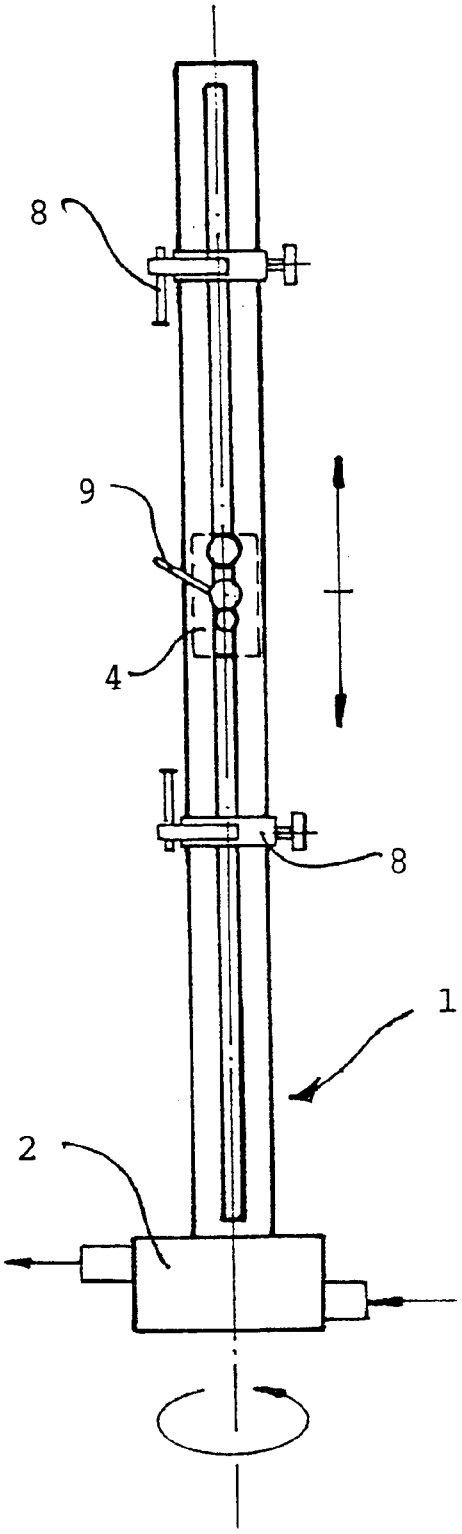
FIG. 6 is a elevation view of a second embodiment of the invention.

With particular reference to FIGS. 2 to 5 a first embodiment of the present invention includes a mechanism having an axially fixed screw rotating only in one direction, and a nut screw moving axially within a tube 6 to which rotating brushes, massaging rolls, a shower head, and so on can be secured. Such mechanism has an essentially cylindrical shape and is driven by a water-driven motor 2 preferably provided with demultiplier.

More particularly, the disclosed mechanism includes in combination a screw 3 provided with two separate right-hand, left-hand helical grooves 7, a nut screw 4 coaxial to screw 3, whose toothing is formed of only one tooth or pawl 5 which has an elongated shape and is pivoted about an axis located radially with respect to the axis of nut screw 4 and is able to rotate about said radial axis and to engage alternatively one of the two helical grooves, and a water-driven motor 2 which rotates said screw and consequently causes nut screw 4 to shift along its axis.

The above-mentioned figures show how said oscillating tooth or pawl 5 is inclined so as to follow the angle of the helical groove in which it is put. Once one of the limit stops such as the upper limit stop (FIG. 3) is reached, inclined pawl 5 reaches the end portion of screw 3 which continues rotating in the same direction. As a result, the chamfered end of pawl 5 contacts the bottom of screw 3, i.e. a surface perpendicular to the axis of the screw itself, thus causing the tooth or pawl to rotate to a horizontal position. The constant rotation of screw 3 causes the initial portion of the groove having a helical profile 7 opposite to the other portion to contact said pawl 5 which is then forced to incline in the opposite direction so as to follow the helical profile of the downward groove.

Once the lower limit stop is reached, the same movements are repeated so that tooth or pawl 5 is caused to rotate and to engage the upward groove.

It is self-evident that, as already disclosed, nut screw 4 axially integral with pawl 5 moves upwards or downwards between the two upper and lower limit stops, and screw 3 is rotated by motor 2 always in the same direction.

It should be appreciated that the invention provides a particularly advantageous combination of elements. Actually, water-driven motor 2 provided with demultiplier is affected by an almost negligible pressure loss so that the user of the present invention does not sense any difference even in water-driven sanitary fixtures where the pressure is not high such as domestic fixtures and particularly in flats located at high floors.

A second embodiment shown in FIGS. 6–13 further provides the regulation of the upper and lower limit stops. In this case, the user may vary the position of each limit stop at will and independently so as to adapt the mechanism to his own particular requirements.

In this second embodiment, the device, includes two limit stops 8 adjustable in height and capable of interacting with a motion reversing control lever 9 which rotates the already-described pawl 5 so that the latter reverses its inclination and, engages the opposite groove. Accordingly, also the motion of nut screw 4 is reversed.

Figure 7:
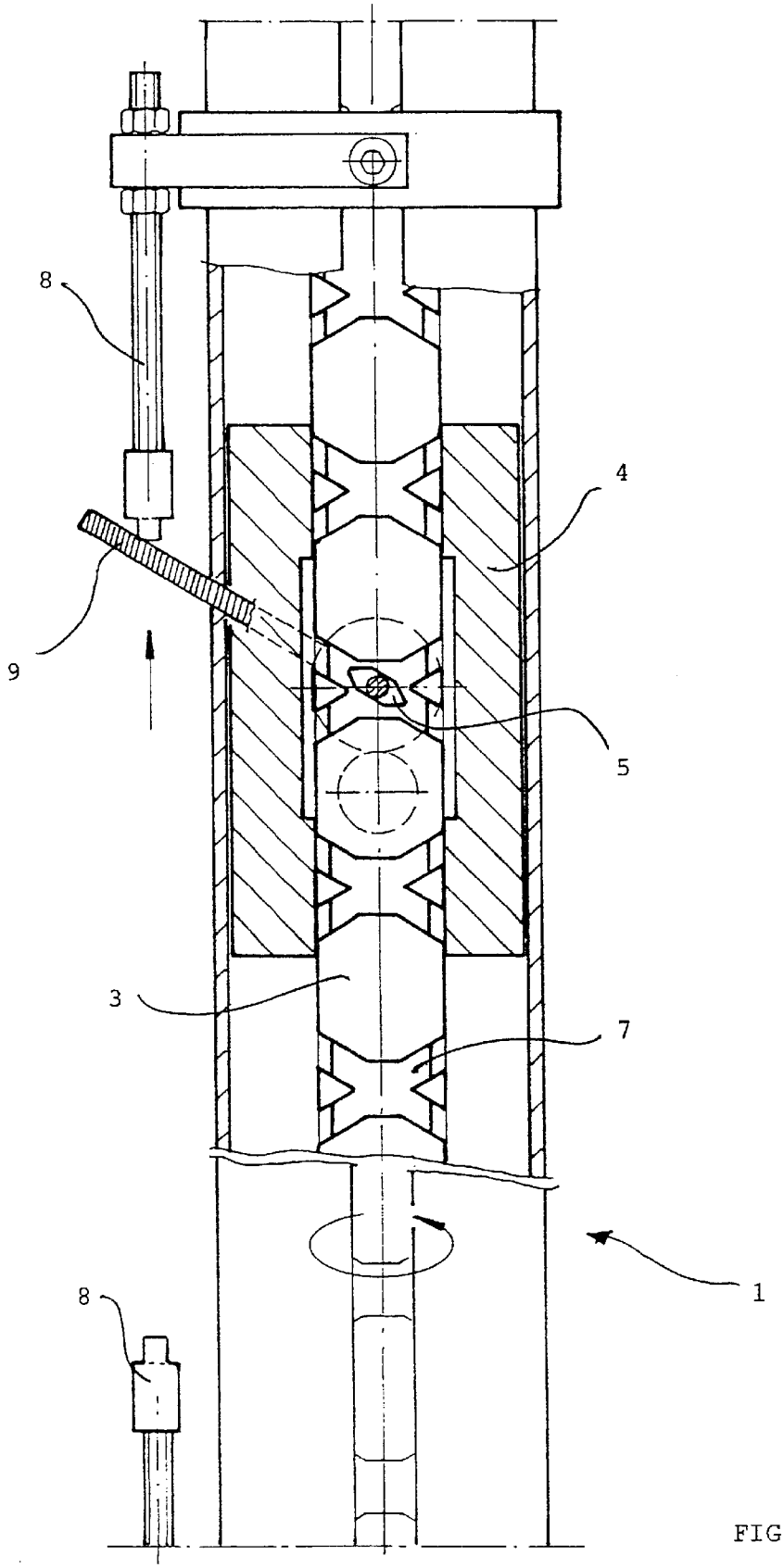
FIG. 7 is a partial section of the apparatus of FIG. 6 showing the position of the upper limit stop.
Figure 8:
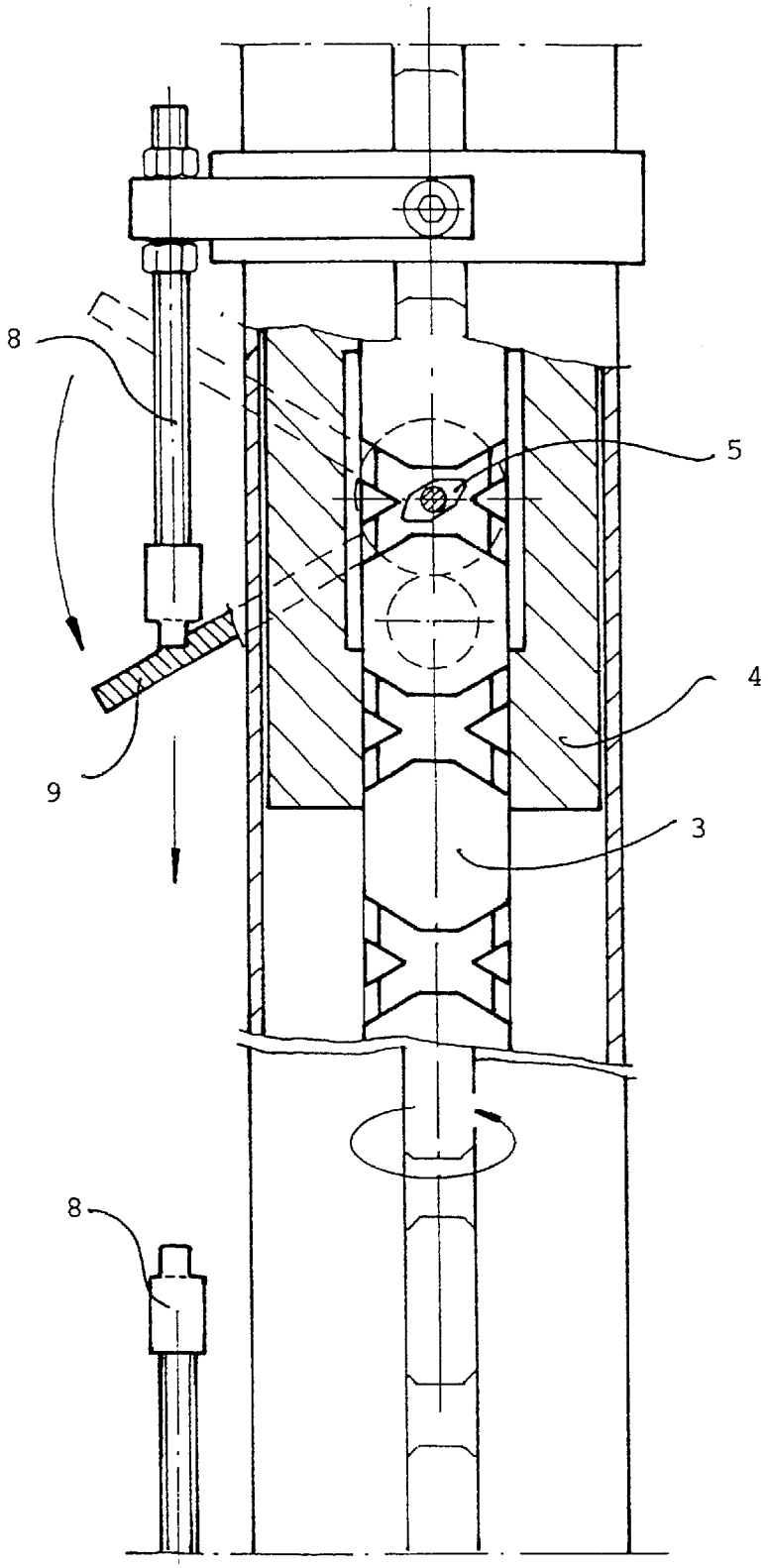
FIG. 8 shows the reversal of the mesh between screw and nut screw.
Figure 9:
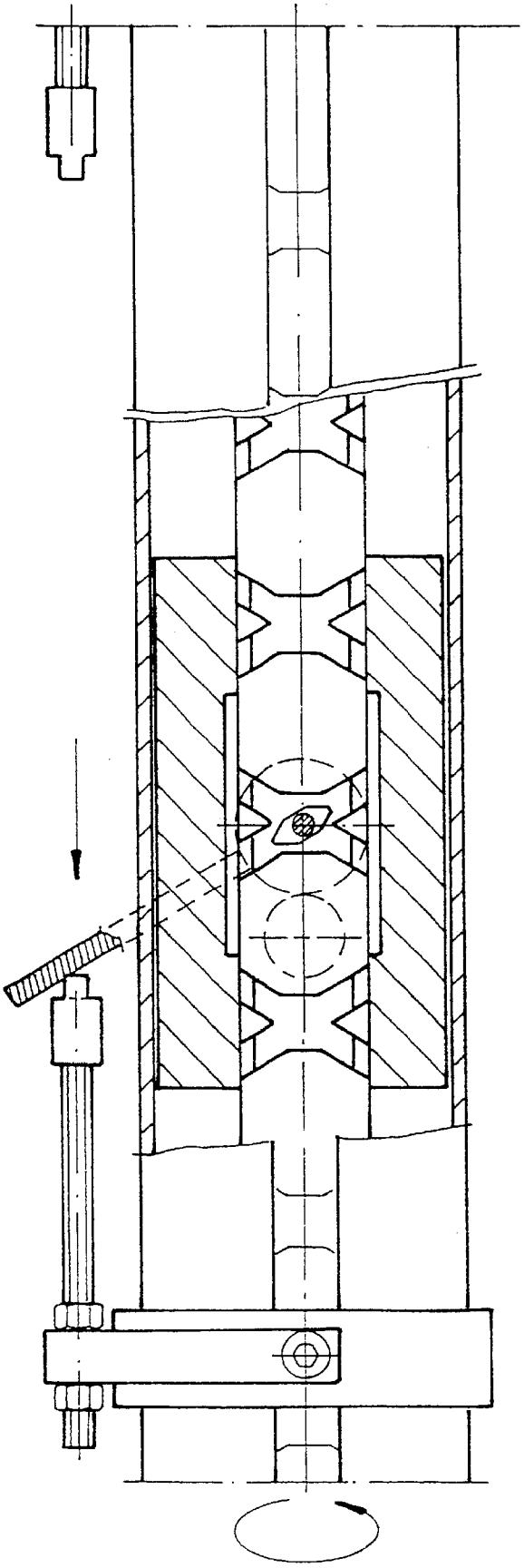
FIG. 9 shows the position of the lower limit stop.
Figure 10:
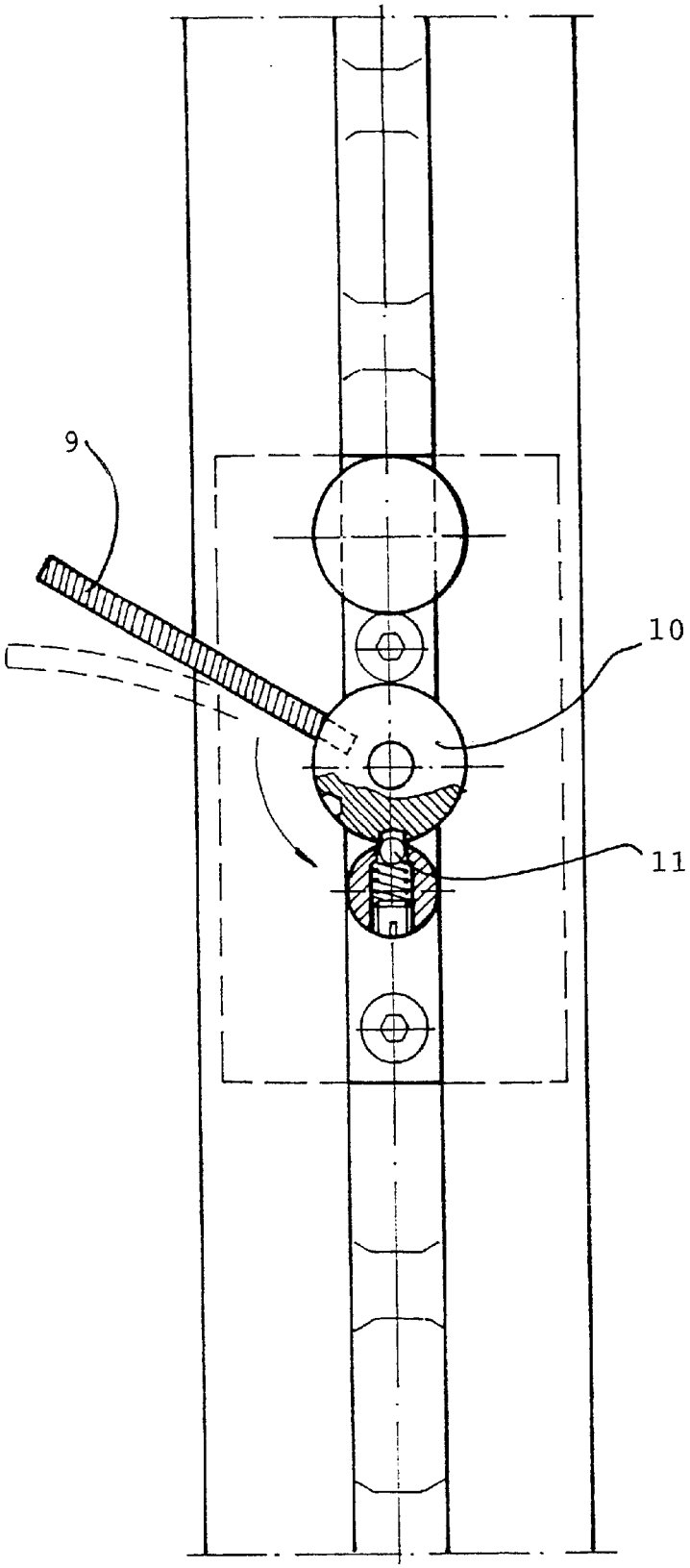
FIG. 10 is a detail of the device for the automatic locking of the flexible control lever.
Figure 11:
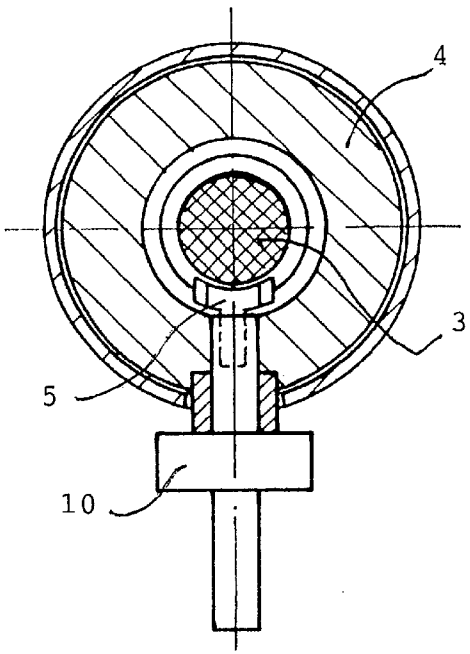
FIG. 11 is cross section view of the mesh between screw and nut screw of the apparatus of FIG. 6.
Figure 12:
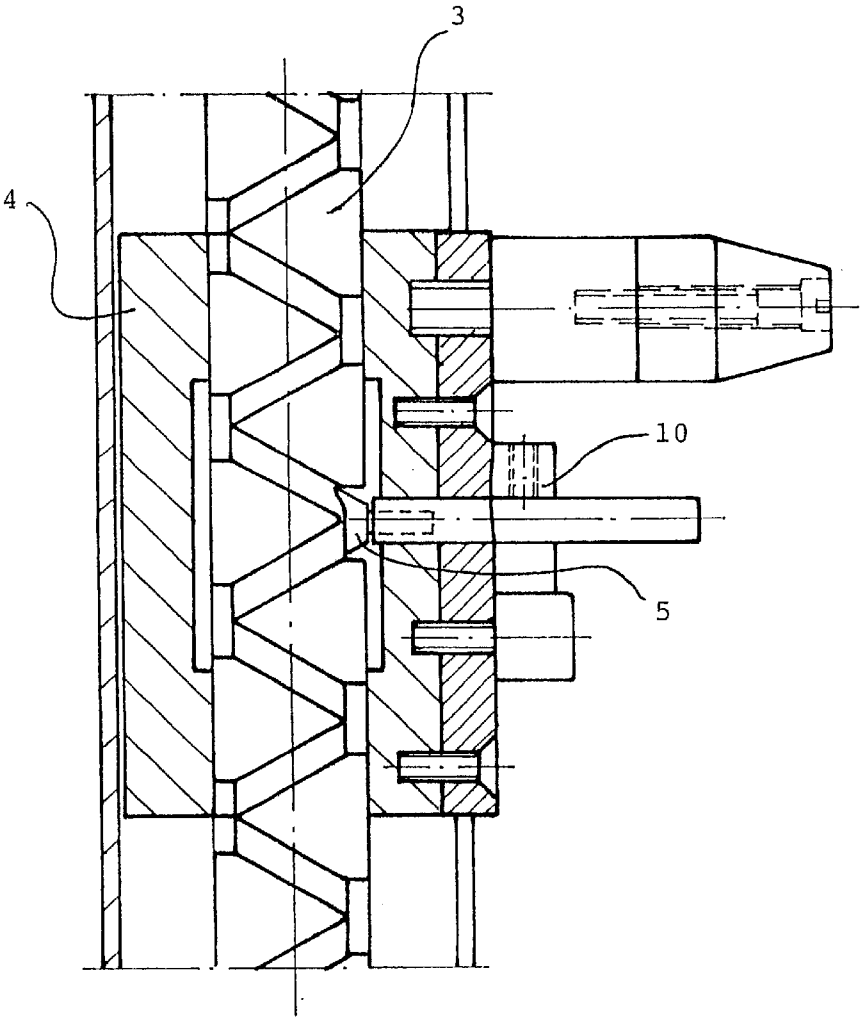
FIG. 12 is a detail of an axial section of the meshing area.
Figure 13:
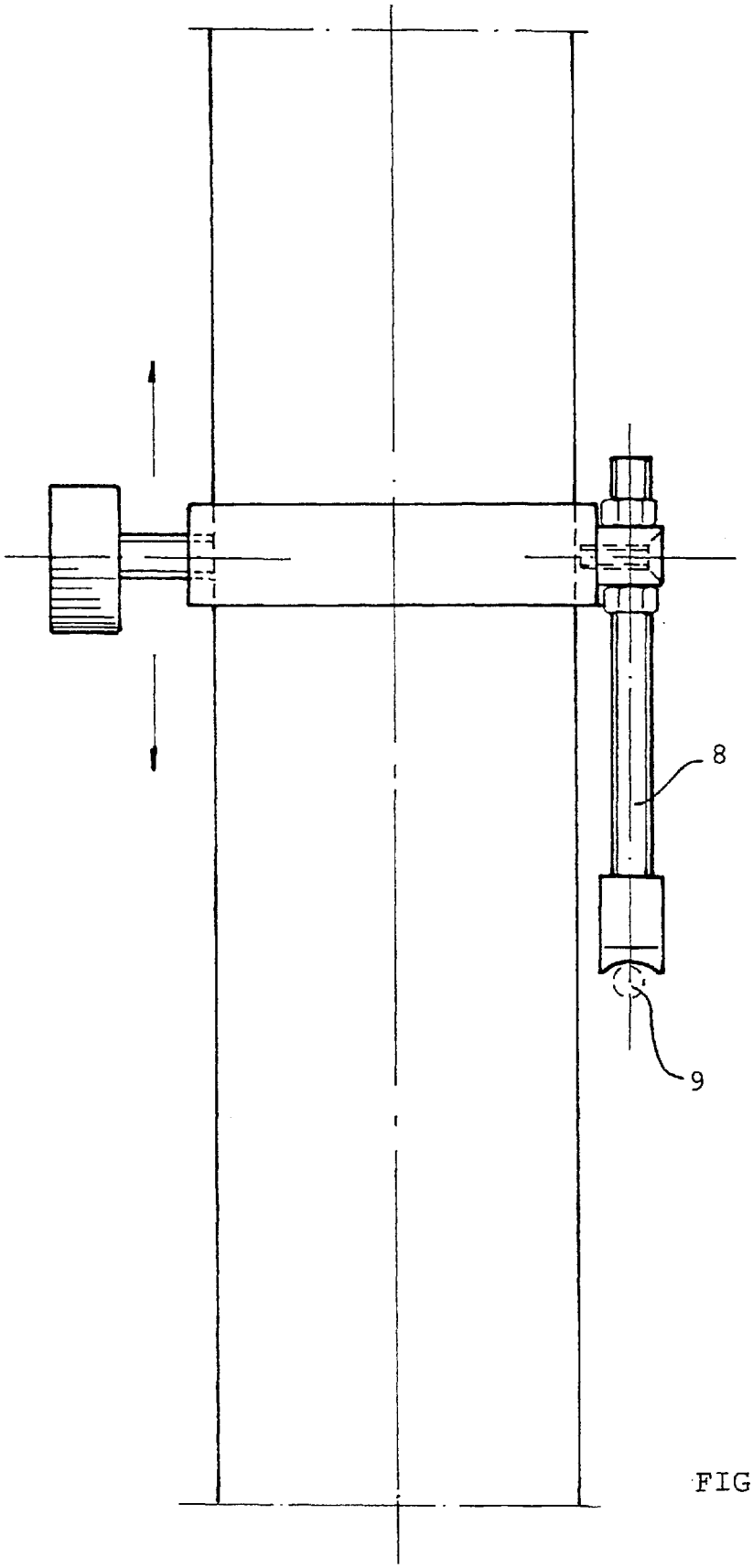
FIG. 13 is a detail of a limit stop device.

FIGS. 7, 8 and 9 show that, according to a peculiar feature of the present invention, the two helical grooves 7 of screw 3 are chamfered at the crossing of upward and downward grooves. More particularly, the corners provided with tips directed upwards or downwards are chamfered in order to facilitate the rotation of pawl 5 controlled by lever 9.

A second peculiar feature of the invention is that control lever 9 is provided, at the contact area with limit stops 8, with a flexible end portion which allows the lever and then pawl 5 to be shortly shifted in the vertical direction after the limit stop is reached.

Such feature is very important because it avoids breaks and/or stoppages that could be caused by a rigid control lever 9 in case one limit stop engages such lever when pawl 5 integral therewith is at a position within groove 7 that does not correspond to a crossing of upward and downward grooves.

Advantageously, in order to avoid that during the stroke between the two limit stops pawl 5 assumes by chance a horizontal position or a not correct inclination, thus causing the stoppage of mechanism 1, control lever 9 is provided with an automatic locking device 10 able to keep pawl 5 in the correct inclination in engagement with any groove 7 until control lever 9 is driven by any limit stop 8.

Said automatic locking device 10 is preferably of the type provided with a locked ball 11 which is depressed by a suitable spring into a suitable hemispheric seat 12 formed at the two upward and downward positions. Therefore, when lever 9 is driven, the ball leaves its seat to reach the opposite seat where it remains until the lever is driven again.

It should be appreciated that the presence of such automatic locking device causes lever 9 to exert a determined force which is necessary to overcome the resistance due to the thrust of the spring urging ball 11 so that pawl 5 can be rotated for reversing the movement. Thus, pawl 5 is always rotated in a very fast manner so that stoppages of the device are advantageously avoided.

As an advantage, the peculiar combination of elements featured by the present invention fully avoids electrical discharges that could take place in case of an electrical control.

Another advantage is due to the fact that the water drive does not, need any pressurization device or plant which would be necessary in case of oil-driven or pneumatic mechanisms.

Still another advantage of the invention is its applicability to showers and tonic-massage fixtures without reduction of the water pressure and without dripping of mixed water supplied by the motor to the shower, sponges and so on.

All of these advantages makes the invention applicable to any existing plumbing without the need of modifications and/or building works. It is only requested to connect the device to the shower coupling to put it perfectly in operation.

It should be noted that the invention can also be applied to gardening, for example, to provide water-driven mechanism for the water sprayers that could be self-moving according to an automatic back-and-forth movement, e.g. watering a garden all over its length by a water-driven mechanism mounted on wheels.

The present invention is described and illustrated according to some preferred embodiment thereof, however, it should be understood that those skilled in the art could make modifications and/or equivalent replacements without departing from the scope of the present industrial invention.

What is claimed is:

1. A water-driven traverse-reverse apparatus for a water fixture that is driven by a motor (2) with a demultiplier and that has an axially moving device, the apparatus comprising:

means for automatically reversing movement of the axially moving device; and a mechanism including in combination an axially fixed screw (3) rotating only in one direction and a nut screw (4) moving axially and meshing with said axially fixed screw and to which one of a rotating brush, massaging roll, and a shower head can be secured, said mechanism having an essentially cylindrical shape and being driven by the motor (2), wherein said axially fixed screw (3) is provided with two separate right-hand, left-hand helical grooves (7), and said nut screw (4) has a toothing formed of only one tooth or pawl (5) which has an elongated shape and is pivoted about an axis located radially with respect to an axis of said nut screw (4) and is able to rotate about said radial axis and to engage alternatively one of the two helical grooves (7), the rotation of said screw (3) causing said tooth or pawl (5) to shift and said nut screw (4) to move axially.

2. The water-driven apparatus according to claim 1, wherein the motor is water-driven.

3. The water-driven apparatus according to claim 1, wherein said tooth or pawl (5) reaches a limit stop and assumes an inclination of the one of said helical grooves (7) in which said tooth or pawl (5) is put.

4. The water-driven apparatus according to claim 1, wherein after water leaves the motor (2), the water is supplied to a shower without any reduction of water pressure and without dripping of water.

5. The water-driven apparatus according to claim 3, further comprising upper and lower limit stops (8) that are adjustable in height and that vary an excursion of the shift of the nut screw, said limit stop interacting with a lever (9) which controls said tooth or pawl (5) for reversing the movement and rotates said tooth or pawl (5) so that said tooth or pawl (5) engages the other of said two helical grooves so as to reverse the motion of said nut screw (4).

6. The water-driven apparatus according to claim 5, wherein corners of the two helical grooves (7) of screw (3) are chamfered at crossings of upward and downward grooves in order to facilitate rotation of said tooth or pawl (5) controlled by said lever (9).

7. The water-driven apparatus according to claim 5, wherein said lever (9) is provided with a flexible end portion which allows the lever and then said tooth or pawl (5) to be shifted in a vertical direction after the limit stop is reached.

8. The water-driven apparatus according to claim 5, wherein said lever (9) is provided with an automatic locking device (10) able to keep said tooth or pawl (5) in a correct inclination in engagement with one of said two helical grooves (7) until said lever (9) is driven by the limit stop (8).

9. The water-driven apparatus according to claim 8, wherein said automatic locking device (10) is provided with a locked ball (11) which is depressed by a suitable spring into a suitable seat (12).

* * * * *

UNITED STATES PATENT AND TRADEMARK OFFICE

CERTIFICATE OF CORRECTION

PATENT NO. : 6,460,203 B1
DATED : October 8, 2002
INVENTOR(S) : Fiorentino De Simone It is certified that error appears in the above-identified patent and that said Letters Patent is hereby corrected as shown below:

Title page,
Item [76], amend to read as follows:

-- [76] Inventor: Fiorentino De Simone, Largo Olgiata, 15-Isola 2/E 00123, Rome (IT) --.

Signed and Sealed this

First Day of April, 2003

JAMES E. ROGAN
*Director of the United States Patent and Trademark Office*